United States Patent [19]

Edel

[11] 4,296,903

[45] Oct. 27, 1981

[54] ACTUATOR BUTTON APPARATUS FOR ADJUSTABLE CHAIRS

[75] Inventor: Hans J. Edel, Minden, Fed. Rep. of Germany

[73] Assignee: Drabert Söhne Minden, Fed. Rep. of Germany

[21] Appl. No.: 86,610

[22] Filed: Oct. 19, 1979

[30] Foreign Application Priority Data

Oct. 23, 1978 [DE] Fed. Rep. of Germany ... 7831578[U]

[51] Int. Cl.[3] ..... F16M 11/00; A47C 3/22

[52] U.S. Cl. ..... 248/162.1; 248/631

[58] Field of Search ..... 248/162.1, 404, 631; 74/2; 297/347, 345

[56] References Cited

U.S. PATENT DOCUMENTS 3,150,855 9/1964 Carter et al. ..... 248/631 X 3,711,054 1/1973 Bauer ..... 248/631 X 3,790,119 2/1974 Bauer ..... 248/631 X 3,880,465 4/1975 Scheben ..... 248/631 X 4,108,416 8/1978 Nagase et al. ..... 248/631

FOREIGN PATENT DOCUMENTS 2031057 4/1980 United Kingdom ..... 248/162.1

*Primary Examiner*—Francis K. Zugel

*Attorney, Agent, or Firm*—Pollock, Vande Sande & Priddy

[57] ABSTRACT

An improved actuator button apparatus is disclosed for use in adjustable chairs. The manually actuable button is pressed through an aperture in the chair frame and then moved along a pivoted lever until the button reaches a retention position. Movement of the lever activates or deactivates a chair positioning linkage within the housing.

8 Claims, 3 Drawing Figures

ACTUATOR BUTTON APPARATUS FOR ADJUSTABLE CHAIRS

DESCRIPTION

1. Technical Field

The invention relates to actuating devices for positioning elements on chairs, particularly pneumatic cushioning elements in which a spring loaded actuator button locks or releases the positioning elements via a linkage.

2. Background Art

In a known device of this type, a pneumatic cushioning element can be adjusted by pressing an actuator button and then adjusting the chair's position. When the button is released, the pneumatic element is locked so that the chair remains in the assumed position. It is always necessary to press the button in order to release the pneumatic element.

DISCLOSURE OF THE INVENTION

An object of the present invention is to improve the previously mentioned chair positioning apparatus so that the adjustable chair elements such as the seat or the backrest can continually follow the movements of the user's body.

To achieve this object, a preferred embodiment of the invention comprises an actuator button mounted on a rod or linkage element, so as to be slidable on the linkage element at an angle transverse and preferably at right angles to the direction of pressure. The button latches behind a rigid locating surface in the chair base housing, when the button is pushed in and slid along the linkage element. It is possible with such a relatively simple construction to maintain the valve of the pneumatic element continually open so that, as a result, both the seat and the backrest remain movable.

In the preferred embodiment, the operating button is provided with a return spring which on the one hand enhances the latching effect and on the other hand ensures an automatic return of the operating button from the latched position upon release.

In the preferred embodiment of the invention, the rod is pivotably mounted and operates the control valve of a pneumatic cushioning element via an intermediate element. The intermediate element preferably is a pivotably mounted, angled lever, one arm of which cooperates with the rod and the other arm of which cooperates with the release button for the control valve.

BRIEF DESCRIPTION OF THE DRAWING

In the following, a preferred embodiment of the invention will be described with reference to the drawing in which.

BEST MODE FOR CARRYING OUT THE INVENTION

Figure 1:
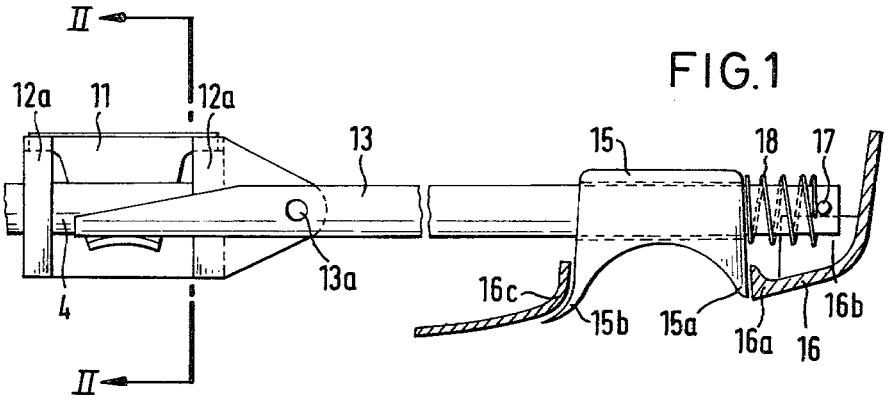
FIG. 1 shows a side view, partially in section, of a chair positioning linkage embodying the invention, wherein the actuator button has not been pressed.
Figure 2:
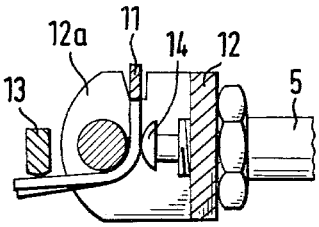
FIG. 2 shows a view, partially in section, taken along line II—II of FIG. 1, illustrating the valve release area of the pneumatic element.
Figure 3:
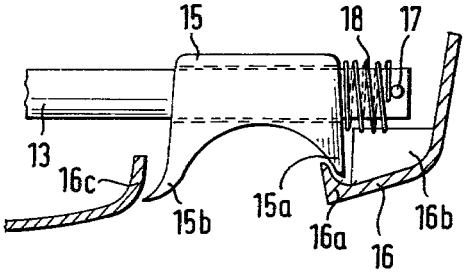
FIG. 3 shows the right hand portion of the illustration according to FIG. 1 with the actuator button latched.

A pneumatic cushioning element 5 has a release button 14 which cooperates with one arm of an angled lever 11. The vertically extending arm of angled lever 11 is pivotably mounted in a slot provided in the arms 12*a* of a mounting block 12. Lever 11 extends beneath and is restrained against certain movement by a bearing bar 4. One end of a pivoted linkage element or rod 13 rests on the horizontally extending arm of angled lever 11 and pivots about a rigid axis 13*a* located in mounting block 12.

An actuator button 15 is mounted at the other end of rod 13, slideable along the rod against the pressure of a return spring 18 which acts at one end on a limiting pin 17, and at the other end on the side of button 15. An aperture is provided in the base cover 16 of the chair seat, the aperture having an inwardly extending locating surface 16*a* on one side and a curved slide surface 16*c* on the other side. In the position shown in FIG. 1, the aperture essentially is filled by actuator button 15. The actuator button has a downwardly protruding latch finger 15*a* at one side and a rearwardly extending sealing vane 15*b* at the other side.

To release cushioning element 5, actuator button 15 is first pressed in, then moved along rod 13 against the force of return spring 18, and finally released. Latch finger 15*a* latches behind locating surface 16*a* of the base cover 16 of the chair base housing which encases the underside of the chair seat. Lever 11 thus is rotated to push release button 14, so that the control valve of pneumatic element 5 remains open and, as a result, the seat remains movable. The same principle can be applied for the operation of a backrest.

In the open position, the limiting pin 17 which retains the pressure spring 18 on the rod 13 has been lifted from the abutments 16*b* and compressed. Renewed pressure on actuator button 15 frees latch 15*a* from locating surface 16*a*. Assisted by the force of the return spring 18, actuator button 15 slides back to its original position shown in FIG. 1. Flexible sealing vane 15*b* closes the gap between base cover 16 and actuator button 15 to prevent pinching of the user's fingers as button 15 slides back to the position shown in FIG. 1 where sealing vane 15*b* overlies the specially formed curved portion 16*c* of base cover 16. Thus, a completely smooth form for the base of the seat is afforded so that damaging or bending of the operating mechanism is quite difficult.

INDUSTRIAL APPLICABILITY

The invention is particularly applicable to control mechanisms for pneumatically positionable chair seats and back rests. Those skilled in the art will appreciate, however, that it may be applied to chairs having other types of control mechanisms. The scope of the invention, however, is to be limited only by the appended claims.

Having described my invention in sufficient detail to enable those skilled in the art to make and use it, I claim:

1. An actuator button apparatus for actuating a chair positioning linkage mounted for movement within a chair base housing, said apparatus comprising:

an aperture in said housing;

a linkage element mounted for movement within said housing;

an actuator button moveable within said aperture, said button being slidably mounted on said linkage element and adapted for movement with said linkage element at least partially into said housing and then along said linkage element at an angle transverse to the initial direction of pressure exerted to move said button into said housing; and means located within said housing for releasably retaining said button after said button has been pressed into said housing and moved along said linkage element.

2. Apparatus according to claim 1, wherein said linkage element is pivotably mounted within said housing, further comprising a pneumatic cushioning element for positioning the chair associated with said base housing and means actuated by said linkage element for activating and deactivating the pneumatic cushioning element.

3. Apparatus according to claim 2, wherein said activating and deactivating means comprises a pivotably mounted, angled lever, one arm of which cooperates with said linkage element and the other arm of which cooperates with said pneumatic cushioning element to activate and deactivate it.

4. Apparatus according to claim 1, further comprising a return spring biasing said button against movement along said linkage element.

5. Apparatus according to claim 4, wherein said linkage element is pivotably mounted within said housing, further comprising a pneumatic cushioning element for positioning the chair associated with said base housing and means actuated by said linkage element for activating and deactivating the pneumatic cushioning element.

6. Apparatus according to claim 5, wherein said activating and deactivating means comprises a pivotably mounted, angled lever, one arm of which cooperates with said linkage element and the other arm of which cooperates with said pneumatic cushioning element to activate and deactivate it.

7. Apparatus according to claim 1, wherein said button comprises means for preventing pinching of the user's fingers between said housing and said button.

8. Apparatus according to claim 1, wherein said retaining means comprises a latch finger protruding from said button and a cooperating locating surface protruding from said housing adjacent said aperture.

* * * * *